US006860985B2

(12) United States Patent
Siskin et al.

(10) Patent No.: US 6,860,985 B2
(45) Date of Patent: Mar. 1, 2005

(54) PROCESS FOR INCREASING YIELD IN COKING PROCESSES

(75) Inventors: Michael Siskin, Randolph, NJ (US); Ramesh R. Hemrajani, Vienna, VA (US); Glen E. Phillips, Goldvein, VA (US); Simon R. Kelemen, Annandale, NJ (US); Kuangnan Qian, Belle Mead, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 72 days.

(21) Appl. No.: 10/293,397

(22) Filed: Nov. 12, 2002

(65) Prior Publication Data

US 2003/0106838 A1 Jun. 12, 2003

Related U.S. Application Data

(60) Provisional application No. 60/341,111, filed on Dec. 12, 2001.

(51) Int. Cl.[7] ..... C10Q 55/00

(52) U.S. Cl. ..... 208/48 R; 208/48 AA; 208/131; 208/100; 208/102; 208/103

(58) Field of Search ..... 208/48 R, 48 AA, 208/131, 100, 102, 103

(56) References Cited

U.S. PATENT DOCUMENTS

| | | | | |
|---|---|---|---|---|
| 2,882,237 | A | 4/1959 | Mahoney | 252/186 |
| 3,654,940 | A | 4/1972 | Ritzi | 134/2 |
| 3,702,816 | A | 11/1972 | Hammer et al. | 208/50 |
| 5,725,756 | A | 3/1998 | Subramaniam et al. | 208/48 |
| 2003/0047072 | A1 * | 3/2003 | Siskin et al. | 95/237 |
| 2003/0047073 | A1 * | 3/2003 | Siskin et al. | 95/253 |
| 2003/0052042 | A1 * | 3/2003 | Siskin et al. | 208/48 AA |

FOREIGN PATENT DOCUMENTS

| | | |
|---|---|---|
| GB | 844698 | 8/1960 |

* cited by examiner

*Primary Examiner*—Walter D. Griffin
*Assistant Examiner*—James Arnold, Jr.
(74) *Attorney, Agent, or Firm*—Erika S. Wilson; Jeremy J. Kliebert

(57) ABSTRACT

The invention relates to a method for improving yield in petroleum streams derived from coking processes. In a preferred embodiment, the invention relates to a method for regenerating filters employed to remove particulate matter from coker gas oil to improve coker gas oil yield and yield of upgraded coker gas oil products.

12 Claims, 2 Drawing Sheets

PROCESS FOR INCREASING YIELD IN COKING PROCESSES

CROSS-REFERENCE TO RELATED APPLICATION

This application claims benefit of U.S. provisional patent application serial No. 60/341,111 filed Dec. 12, 2001.

FIELD OF THE INVENTION

In an embodiment, the invention relates to a method for improving yield in petroleum streams derived from coking processes. In a preferred embodiment, the invention relates to a method for regenerating filters employed to remove particulate matter from coker gas oil to improve coker gas oil yield and yield of upgraded coker gas oil products.

BACKGROUND OF THE INVENTION

Petroleum coking relates to processes for converting high boiling point, heavy petroleum feeds such as atmospheric and vacuum residua ("resid") to petroleum coke ("coke") and hydrocarbon products having atmospheric boiling points lower than the feed's. Some coking processes, such as delayed coking, are batch processes where the coke accumulates and is subsequently removed from a reactor vessel. In fluidized bed coking, for example fluid coking and FLEXICOKING (available from ExxonMobil Research and Engineering Co., Fairfax, Va.), lower boiling products are formed by the thermal decomposition of the feed at elevated reaction temperatures, typically about 900 to 1100° F. (about 480 to 590° C.) using heat supplied by fluidized coke particles.

Following coking, the lower boiling hydrocarbon products, such as coker gas oil, are separated in a separation region and conducted away from the process for storage or further processing. Frequently, the separated hydrocarbon products contain coke particles, particularly when fluidized bed coking is employed. Such coke particles may range in size upwards from submicron to several hundred microns, typically, submicron to about 50 $\mu$m. It is generally desirable to remove particles larger than about 25 $\mu$m to prevent fouling of downstream catalyst beds used for further processing. Filters, located downstream of the separation zone, are employed to remove coke from the products. Undesirably, solid hydrocarbonaceous particles present in the separated lower boiling hydrocarbon products may physically bind to each other and the filters, resulting in filter fouling, and, consequently, reduced filter throughput. There is an inability to effectively backwash fouled filters to remove foulant because the described foulant sticks to the filter. The accumulation of this sticky foulant reduces backwash effectiveness and thereby shortens the filter cycle, resulting in a lower yield of filtered gas oil.

There is therefore a need for a method for regenerating such filters to improve yield in petroleum coking product streams.

SUMMARY OF THE INVENTION

Figure 1:
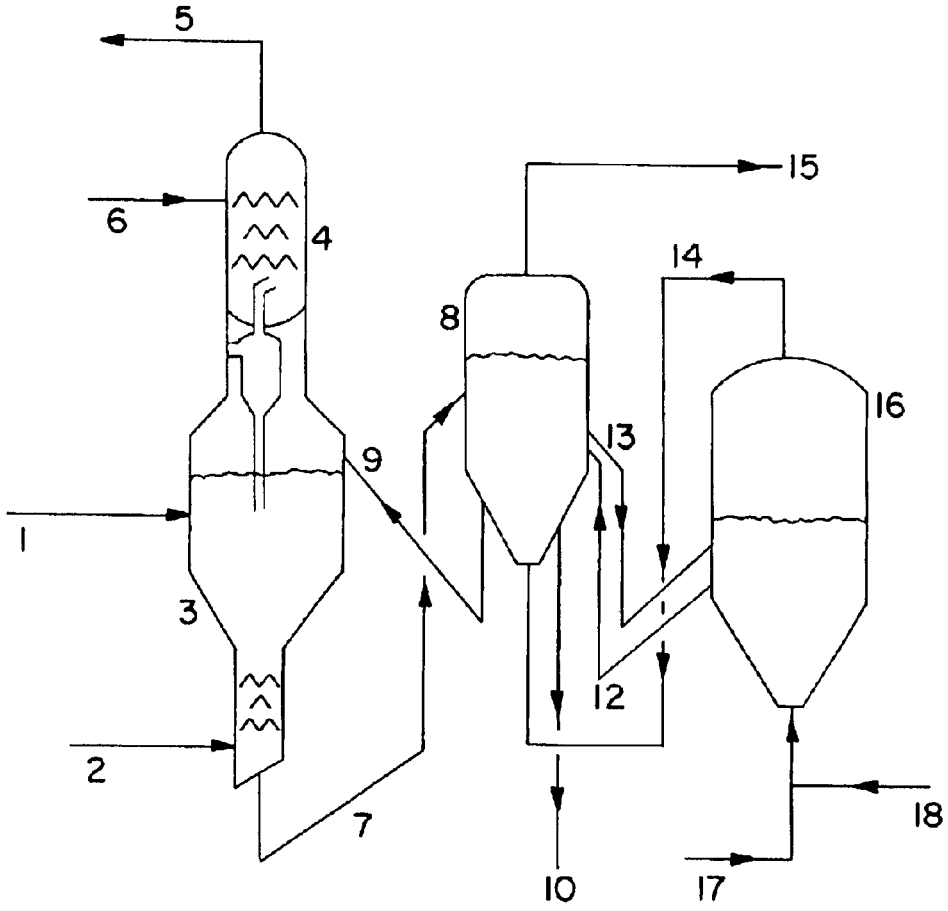
FIG. 1 is a schematic representation of a FLEXICOKING process.

In one embodiment, the invention relates to a method for improving throughput in a coking process, comprising:

a. conducting an effluent stream from a coking process to a first separation region;

b. separating at least a light fraction in the first separation region;

c. conducting steam and the light fraction to a second separation region and separating a vapor fraction and a liquid hydrocarbon fraction;

d. conducting the liquid hydrocarbon fraction back to the first separation zone;

e. separating in the first separation region a coker gas oil having a boiling point higher than the light fraction and containing coke;

f. conducting the coker gas oil to a filter and separating a coker gas oil having a reduced coke content during a first step;

g. backflushing the filter to remove accumulated solids during a second step; and h. soaking the filter with a treatment solution comprising hydrogen peroxide to improve coker gas oil yield during a third.

In a preferred embodiment, steps (f) and (g) are continuously repeated in sequence.

DETAILED DESCRIPTION OF THE INVENTION

In an embodiment, the invention is based in part on the discovery that foulant material can form in a separation zone or fractionation system downstream of a coking process resulting in a separated coker gas oil containing coke particles and foulant. The foulant is a coke precursor material that is high in hydrocarbon content, but low in metal content. While it is a coke like material, it is referred to herein as "foulant" to distinguish it from coke particles that have escaped from the coking process.

It has also been discovered that foulant agglomeration results at least in part from the presence of macromolecules in the separation region having a molecular weight ranging up to about 3000, usually from about 1000 up to about 3000. Such macromolecules, including polymers and oligimers, but collectively referred to herein as oligomers, coat the coke's surface resulting in foulant particles that can adhere to each other and the filters employed to remove coke from the gas oil. The presence of foulant particles on the filters results in diminished filter regeneration effectiveness during backflushing steps.

The oligomers form largely from oxygen induced polymerization of conjugated dienes present in the coker effluent. Oligomers of conjugated dienes structurally contain one olefinic double bond per unit of conjugated diene polymerized. Additionally, styrenes and indenes present in the coker effluent may form oligomers and may also be incorporated into the conjugated diene oligomers. As is known to those skilled in the art of polymerization, the presence of unsaturation in a polymer as results from the incorporation of olefinic double bonds and aromatics leads to the formation of a sticky polymer.

It is believed that filter fouling results when the oligomers coat the surface of coke in the high boiling fractions separated from the coker effluent. As temperature increases, these oligomers grow and can become insoluble, gummy materials. Potentially, each double bond in the oligomer is attached by physical interaction to the coke surface forming foulant. It is the sum of all the attachments that gives adhesive strength for the oligomer to hold onto the coke and form a tenacious multilayer sticky coating that then leads to fine coke particles that would otherwise pass through the filter sticking to each other.

In conventional processing of the coker gas oil, the gas oil is conducted to one or more filters during a first step where coke is removed from the gas oil. The filter gradually accumulates coke particles, resulting in reduced filter permeability and lower gas oil yield. Accordingly, a second step is employed following the first step, where the separated gas oil is diverted away from the filter and the filter is backflushed to remove the coke from the filter. Some systems employ gas pressure to assist this backflush. When filter permeability is restored, the second step is concluded and the first step is commenced. The first and second steps may be alternated in a semi-continuous fashion.

The presence of foulant during filtering of the fine (micron and submicron) coke particles leads to agglomeration of the fine particles into particles too large to pass through the filter and therefore to premature plugging of the filters during the first step. Additionally, the adhesive forces mediated by the foulant prevent the effective backflushing and regeneration of the plugged filters. Moreover, foulant attached to the surface of the coke has low solubility in conventional organic and hydrocarbon solvents employed for the optional filter soak step, and, consequently, the effectiveness of the backflush during the second step gradually diminishes as foulant accumulates on the filter.

It has been discovered that the foulant may be removed and filter permeability can be restored by contacting the filter with a treatment solution comprising hydrogen peroxide. It has also been discovered that coke particles coated with foulant can be upgraded by contacting the fouled coke particles with the treatment solution.

While filter fouling may be experienced when processing effluent from any coker process, and the methods described herein may be used to control fouling in all coking processes, an embodiment for mitigating filter fouling in effluent from a FLEXICOKING process will be described in detail as a representative case.

Referring to FIG. 1, fresh feed containing one or more of heavy oil, resid, coal tar, shale oil, bitumen, and the like is pre-heated into a range of about 600° F. to about 700° F. (315 to 370° C.) and then conducted via line 1 to reactor 3 where the feed contacts a hot fluidized bed of coke obtained via line 9 from heater 8. The hot coke provides sensible heat and heat of vaporization for the feed and the heat required for the endothermic cracking reactions. The cracked vapor products pass through cyclone separators at the top of the reactor to remove coke particles for return to the bed. The vapors are then quenched in the scrubber 4 located above the reactor, where a portion (preferably a high boiling portion) of the cracked vapors are condensed and recycled to the reactor. The remaining cracked vapors are conducted to the coker fractionator via line 5. Wash oil is conducted to the scrubber via line 6 to provide quench cooling and to further reduce the amount of entrained coke particles.

Coke produced by cracking forms as a deposit on the surface of existing coke particles in the reactor. Such coke is stripped with steam conducted to the reactor via line 2 and then returned to the heater via line 7 where it is heated to a temperature of about 1100° F. (593° C.). The heater serves to transfer heat from the gasifier 16 to the reactor.

Accordingly, coke flows via line 13 from the heater to the gasifier where the coke reacts with steam, conducted in via line 17 and air conducted in via line 18. A fuel gas product is formed comprising $CO$, $H_2$, $CO_2$, $N_2$, $H_2S$, and $NH_3$. Coke can be returned from the gasifier to the heater via line 12. Fuel gas is conducted from the top of the gasifier via line 14 to the bottom of the heater to assist in maintaining a fluidized coke bed in the heater. Coke gas is removed from the process via line 15. Coke is removed from the process via line 10.

Figure 2:
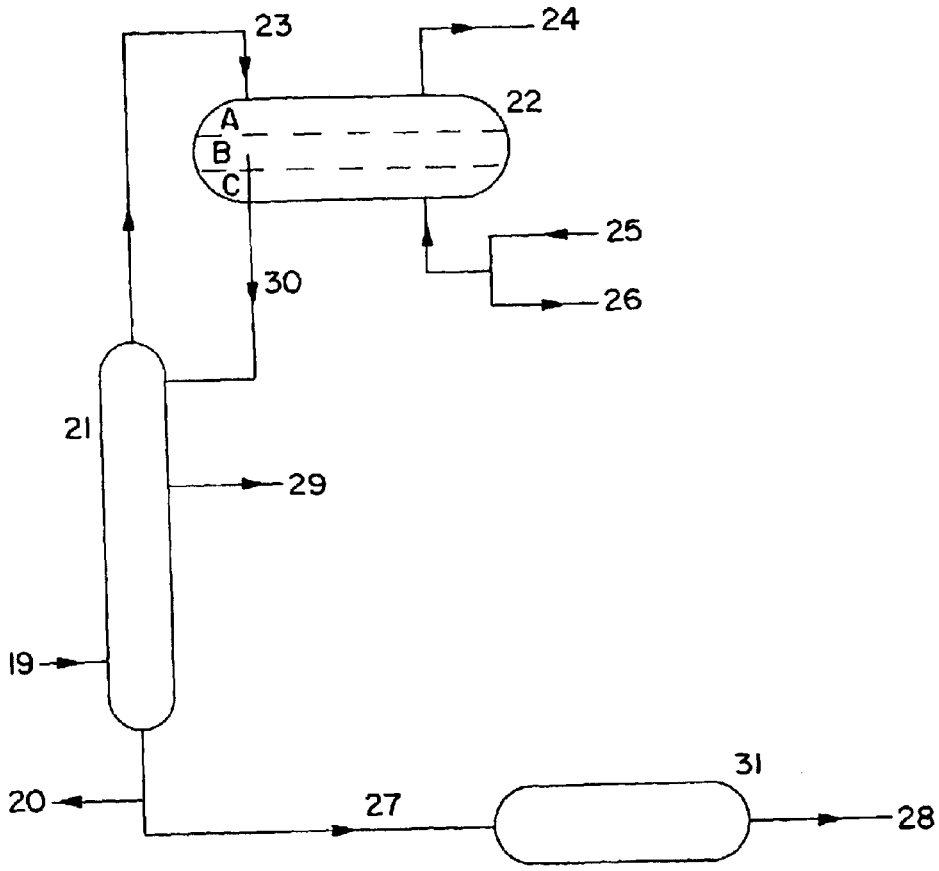
FIG. 2 is a schematic representation of a method for separating and filtering a gas oil product obtained from a coking process such as a FLEXICOKING process.

Referring now to FIG. 2, effluent from the coker is conducted to a first separation region, the coker fractionator 21, via line 19. A stream of coker naphtha is separated from the top of the fractionator (temperature about 230° F. (110° C.) to about 260° F. (127° C.)) and conducted to a second separation region, drum 22, via line 23. Region 22 is maintained in thermal equilibrium at about 110° F. (43° C.). The coker naphtha is very reactive as it contains high concentrations of low molecular weight conjugated dienes compared to the higher boiling fractions. The coker naphtha also can contain styrenes and indenes.

Separation region 22 is divided into three zones. An upper zone (A) contains vapor phase material which may be withdrawn via line 24. An intermediate zone (B) contains liquid hydrocarbon to be returned to the coker fractionator 21 as reflux. A lower zone (C) contains an aqueous liquid to maintain zone B at the proper level in region 22 so that it can be withdrawn via line 30. Excess condensed aqueous material can be conducted away via line 26.

Wash oil is separated in the coker fractionator and returned to the coker via line 20. Coker gas oil is separated and conducted to filter 31 via line 27. Filtered gas oil is conducted away from the process via line 28.

It has been discovered that oxygen present in separation region 22 reacts largely with conjugated dienes and pyrroles in the coker naphtha to form peroxides. One way oxygen can be introduced into the process is via the external streams through line 25. Steam, e.g., obtained from other petroleum processes, may contain upwards of 100 ppm oxygen, based on the weight of the steam. Some refinery steam sources contain as much as 4500 ppm oxygen. The presence of more than 3 ppm oxygen in the steam will lead to the formation of significant quantities, about 0.5 to about 5 ppm, of peroxides with the conjugated dienes in the coker naphtha which, on subsequent heating from 110° F. (43° C.) to 230° F. (110° C.) on entering the top of the coker fractionator, initiate oligomer/polymer-forming chain reactions. Accordingly, unless oxygen is excluded from the process or scavenged, peroxide initiators will form, and the peroxides will initiate the formation of oligomers in the coker fractionator.

In an embodiment, the invention relates to improving yield in a coking process, reducing the frequency of filter backflushing (i.e., increasing the length of the first step compared to the second), and removing an upgraded coke from the filters.

In one embodiment, the pressure drop across the filter is monitored during the first and second step. Initially, during the first step, the pressure drop will be at a first value in the range of about 1 to about 5 psig. The pressure drop increases during the first step as foulant and coke accumulates in and on the filter. When the pressure drop reaches a second value between about 15 and 20 psig, the first step is concluded and the second step is commenced. In one embodiment, backflushing is conducted until the pressure drop is restored into a range of about 1 to about 5 psig. Alternatively, if a bank of two or more filters are in operation, a cyclic regeneration approach may be taken. In this embodiment, the filter bundle to be regenerated is isolated from the process and replaced by the second filter bundle which is put into operation while the first is regenerated in a batch (or semi-continuous) mode.

In another embodiment, the second step is conducted for a time sufficient to remove the sticky coating and form an upgraded coke. It has been discovered using, X-ray photoelectron spectroscopy (XPS), that the foulant and coke have different surface aromaticity. Measured aromaticity of the foulant on the surface of the coke ranged from about 53% to about 55%, whereas bed coke particles average between 75–95%. This lower level of aromaticity indicates a foulant surface coating of lower aromatic material. Accordingly, the second step can have a duration sufficient to effectively restore the surface aromaticity of the coke particle into the range of 75 to about 90% by oxidizing the foulant on the surface, or, until the particles no longer stick together. In other words, it is only necessary to oxidize the foulant on the surface to the point of eliminating stickiness. The oxidized surface, because it is functionalized by the oxidation, will have a lower aromaticity than the unoxidized foulant.

Hydrogen peroxide (30–70%) is the preferred treatment solution for soaking in the third step. The hydrogen peroxide can be used in an aqueous solution, in combination with a second liquid such as acetic acid, and mixtures thereof. Use of aqueous hydrogen peroxide in combination with an organic solvent such as acetic acid facilitates wetting of the organic foulant on the surface of the coke and thereby results in faster rates for the oxidation reaction. Treatment solutions containing oxidizing agents soluble in water, hydrocarbon, or both may be employed. For example, nitric acid, chromic acid, permanganates, ceric oxide, peracetic acid, perbenzoic acid, ozone, and the like can be employed.

When hydrogen peroxide is employed, the duration of the third step will generally range from 15 minutes to 2 hours, preferably 1.5 hours, and more preferably 1 hour at a temperature ranging from 50° C. to 200° C., preferably 100° C. to 200° C., and more preferably from 100° C. to 125° C.

At the conclusion of the third step, the oxidized coke surface may optionally be rinsed with aqueous, aqueous-methanolic, or methanolic potassium iodide or another reducing agent, e.g., 0.3 M potassium iodide in methanol, to destroy peroxides formed on the carbon surface during the backflushing.

What is claimed is:

1. A method for improving yield in a coking process, comprising:

(a) conducting an effluent stream from a coking process to a first separation region;

(b) separating at least a light fraction in the first separation region;

(c) conducting steam and the light fraction to a second separation region and separating a vapor fraction and a liquid hydrocarbon fraction;

(d) conducting the liquid hydrocarbon fraction back to the first separation zone;

(e) separating in the first separation region a coker gas oil having a boiling point higher than the light fraction and containing coke;

(f) conducting the coker gas oil to a filter and separating a coker gas oil having a reduced coke content during a first step;

(g) backflushing the filter to remove accumulated solids during a second step; and (h) soaking the filter with a treatment solution comprising hydrogen peroxide to improve coker gas oil yield during a third step.

2. The method of claim 1 wherein steps (f) and (g) are continuously repeated in sequence.

3. The method of claim 1 further comprising alternating steps (f) and (g) in a semi-continuous fashion.

4. The method of claim 1 wherein the coking process is a FLEXICOKING process.

5. The method of claim 1 wherein the coking process is a Fluidcoking process.

6. The method of claim 1 wherein the coking process is a delayed coking process.

7. The method of claim 1 further comprising monitoring a pressure drop across the filter and concluding the first step when the pressure drop value increases from a first value in the range of about 1 psig to about 5 psig, to a second value in the range of about 15 psig to about 20 psig, and then conducting the second step until the pressure drop ranges from about 1 psig to about 5 psig.

8. The method of claim 1 further comprising determining the surface aromaticity of the coke, concluding the first step when the surface aromaticity ranges from about 53% to about 55%, and concluding the second step when the aromaticity ranges from about 75% to about 95%.

9. The method of claim 1 wherein the treatment solution further comprises acetic acid.

10. The method of claim 1 wherein the treatment solution further comprises nitric acid, chromic acid, permanganates, ceric oxide, peracetic acid, perbenzoic acid, ozone, and the like.

11. The method of claim 1 wherein the second step ranges from about 15 minutes to about 2 hours at a temperature ranging from about 50° C. to about 200° C.

12. The method of claim 1 further comprising (h) rinsing the oxidized coke surface with a reducing agent to destroy peroxide formed on the coke during backflushing.

* * * * *